US009360841B1

(12) United States Patent
Tolani

(10) Patent No.: US 9,360,841 B1
(45) Date of Patent: Jun. 7, 2016

(54) WATCH WITH A TIME-SETTING BEZEL AND SHAFT CONNECTION

(71) Applicant: Vishal Tolani, Kowloon (HK)

(72) Inventor: Vishal Tolani, Kowloon (HK)

( * ) Notice: Subject to any disclaimer, the term of this patent is extended or adjusted under 35 U.S.C. 154(b) by 0 days.

(21) Appl. No.: 14/949,773

(22) Filed: Nov. 23, 2015

(51) Int. Cl.

| | |
|---|---|
| ***G04B 23/00*** | (2006.01) |
| ***G04B 19/28*** | (2006.01) |
| ***G04B 3/00*** | (2006.01) |
| ***G04B 3/02*** | (2006.01) |

(52) U.S. Cl.
CPC ..... *G04B 19/283* (2013.01); *G04B 3/001* (2013.01); *G04B 3/02* (2013.01)

(58) Field of Classification Search
CPC ..... G04B 19/283; G04B 3/001; G04B 3/02
USPC ..... 368/147, 294–296, 27, 15–20, 233, 88, 368/281, 238
See application file for complete search history.

(56) References Cited

U.S. PATENT DOCUMENTS

| | | | | |
|---|---|---|---|---|
| 3,548,588 | A * | 12/1970 | Piquerez | G04B 19/166 368/294 |
| 7,134,784 | B1 | 11/2006 | Marin | |
| 7,434,984 | B2 * | 10/2008 | Hiranuma | G04B 19/283 368/295 |
| 2003/0123332 | A1 * | 7/2003 | Hiranuma | G04B 19/283 368/295 |

* cited by examiner

*Primary Examiner* — Edwin A. Leon
(74) *Attorney, Agent, or Firm* — Law Office of Ilya Libenzon

(57) ABSTRACT

A watch with a time-setting bezel includes a watch face containing a time-telling mechanism including at least one hand, the watch face enclosed in a casing, a rotatable bezel mounted on an annular shoulder of the casing, the rotatable bezel having an axis of rotation substantially perpendicular to the watch face, the rotatable bezel having a cylindrical gear element fixed to the rotatable bezel and projecting into the casing, and a shaft having an axis of rotation substantially orthogonal to the axis of rotation of the rotatable bezel, the shaft mechanically coupled to the cylindrical gear so that the rotation of the bezel drives the rotation of the shaft.

20 Claims, 12 Drawing Sheets

WATCH WITH A TIME-SETTING BEZEL AND SHAFT CONNECTION

TECHNICAL FIELD

This invention relates generally to mechanisms for manual control of chronometric devices, and particularly to a watch with a bezel and shaft connection.

BACKGROUND ART

Analog watches generally require a manually operable mechanism to set the time by moving the hands about the dial until the hands indicate the current time. In recent decades, this mechanism has typically been some variation of a keyless work, in which a rotating shaft selectively engages and turns the minute wheel, hour wheel, cannon pinion, or other portion of the motion works gear train driving the hands of the watch. The shaft is turned by way of a knob, crank, or other rotatable object accessible from outside of the watchcase; traditionally, the object used to control the rotation of the shaft has been a small knob called a crown. Usually the crown can be pulled into different positions to engage a clutch or other gear to various mechanisms within the watch, for instance including a mechanism for winding the watch, if mechanical, a mechanism for adjusting the date, and the mechanism for setting the time. Unfortunately, crowns are small, and can be difficult to manipulate. This is especially problematic with diving watches, which may have a smaller crown concealed under a "canteen" crown cover, and which may be operated by a diver wearing gloves.

Therefore, there remains a need for a more easily manipulable mechanism for setting time or date or winding watches.

SUMMARY OF THE EMBODIMENTS

In one aspect, a watch with a time-setting bezel includes a watch face containing a time-telling mechanism including at least one hand, the watch face enclosed in a casing. The watch includes a rotatable bezel mounted on an annular shoulder of the casing, the rotatable bezel having an axis of rotation substantially perpendicular to the watch face, the rotatable bezel having a cylindrical gear element fixed to the rotatable bezel and projecting into the casing. The watch includes a shaft having an axis of rotation substantially orthogonal to the axis of rotation of the rotatable bezel, the shaft mechanically coupled to the cylindrical gear so that the rotation of the bezel drives the rotation of the shaft.

In a related embodiment, the shaft is mechanically coupled to the cylindrical gear by a special cannon pinion having a pinion gear that engages the cylindrical gear element. In another embodiment, the shaft engages a first gear element within the watch so that rotation of the shaft drives rotation of the first gear element. In an additional embodiment, the first gear element is engaged with the time-telling mechanism so that rotation of the first gear element drives rotation of the at least one hand to set a time. In yet another embodiment, the first gear element is engaged with a date display mechanism so that the rotation of the first gear element drives rotation of the date display mechanism to set a date. In another embodiment still, the first gear element is engaged with a spring winding mechanism so that the rotation of the first gear element drives rotation of the spring winding mechanism to wind a spring.

In another related embodiment, the shaft is axially movable to disengage from the first gear element and engage with a second gear element within the watch. In another embodiment, the second gear element is engaged with the time-telling mechanism so that rotation of the second gear element drives rotation of the at least one hand to set a time. In another additional embodiment, the second gear element is engaged with a date display mechanism so that the rotation of the second gear element drives rotation of the date display mechanism to set a date. In yet another embodiment, the second gear element is engaged with a spring winding mechanism so that the rotation of the second gear element drives rotation of the spring winding mechanism to wind a spring. Another embodiment still also includes a push button projecting from the casing, the push button mechanically coupled to the shaft, so that pushing the push button moves the shaft axially between the first position and the second position. Still another embodiment further includes a lever in the casing, the lever having a proximal end mechanically coupled to the push button so that when the push button is pushed into the case, the proximal end moves further into the case, a fulcrum about which the lever pivots, and a distal end mechanically coupled to the shaft, so that when the shaft is in the second position and the proximal end moves further into the case, the distal end moves the shaft outward from the first position to the second position. An additional embodiment also includes a removable cap that covers the push button.

In a related embodiment, the shaft is axially movable to disengage from the second gear element and engage with a third gear element within the watch. In another embodiment, the third gear element is engaged with the time-telling mechanism so that rotation of the third gear element drives rotation of the at least one hand to set a time. In still another embodiment, the third gear element is engaged with a date display mechanism so that the rotation of the third gear element drives rotation of the date display mechanism to set a date. In yet another embodiment, the third gear element is engaged with a spring winding mechanism so that the rotation of the third gear element drives rotation of the spring winding mechanism to wind a spring. An additional embodiment includes a push button projecting from the casing, the push button mechanically coupled to the shaft, so that pushing the push button moves the shaft axially between the first position, the second position and the third position. A further embodiment also includes a lever in the casing, the lever having a proximal end mechanically coupled to the push button so that when the push button is pushed into the case, the proximal end moves further into the case, a fulcrum about which the lever pivots, and a distal end mechanically coupled to the shaft, so that when the shaft is in the second position and the proximal end moves further into the case, the distal end moves the shaft outward from the second position to the third position. Yet another embodiment includes a removable cap that covers the push button.

In another aspect, a method for controlling a watch using a rotatable bezel includes providing a watch having a keyless work including a shaft that may be selectively engaged to a rotatable bezel. The method includes rotating the bezel to control the watch.

Other aspects, embodiments and features of the disclosed device and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method is shown where illustration is not necessary to allow those of ordinary skill in the art to understand the device and method.

BRIEF DESCRIPTION OF THE DRAWINGS

The following detailed description of the device and method will be better understood when read in conjunction with the attached drawings. It should be understood that the system and method is not limited to the precise arrangements and instrumentalities shown.

DETAILED DESCRIPTION OF SPECIFIC EMBODIMENTS

Embodiments of the disclosed device replace the conventional crown-based keyless work mechanism with a more easily manipulated rotatable bezel. In some embodiments, a push-button on the exterior of the watchcase allows a user to engage the rotatable bezel with one or more mechanisms to set the date or time, or wind the watch. The button may be covered with a canteen crown cover to help waterproof the watch. As a result, even a user encumbered with gloves may be able to wind the watch or adjust the time or date by rotating the watch bezel.

Figure 1A:
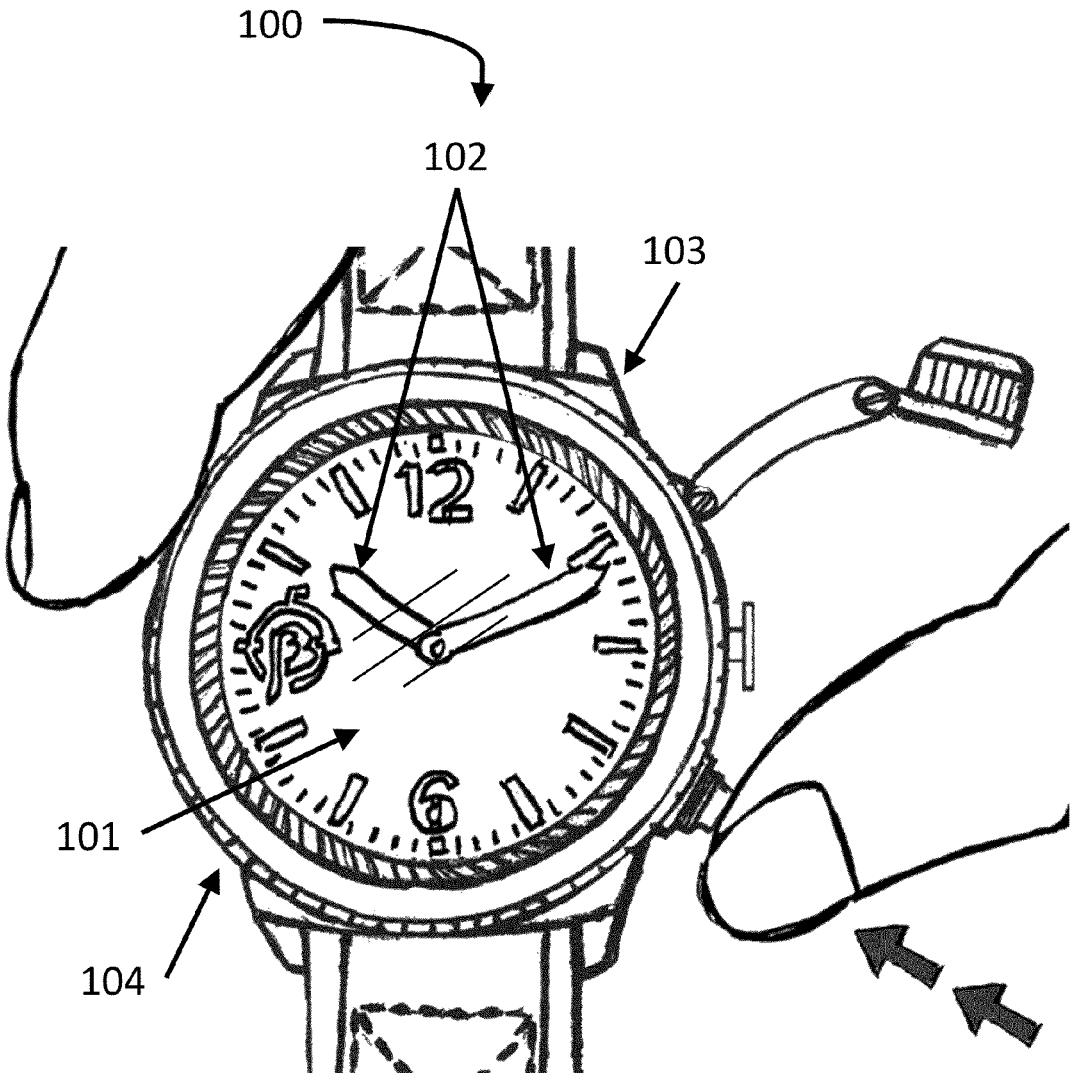
FIG. 1A is a schematic diagram showing one embodiment of the watch.
Figure 1B:
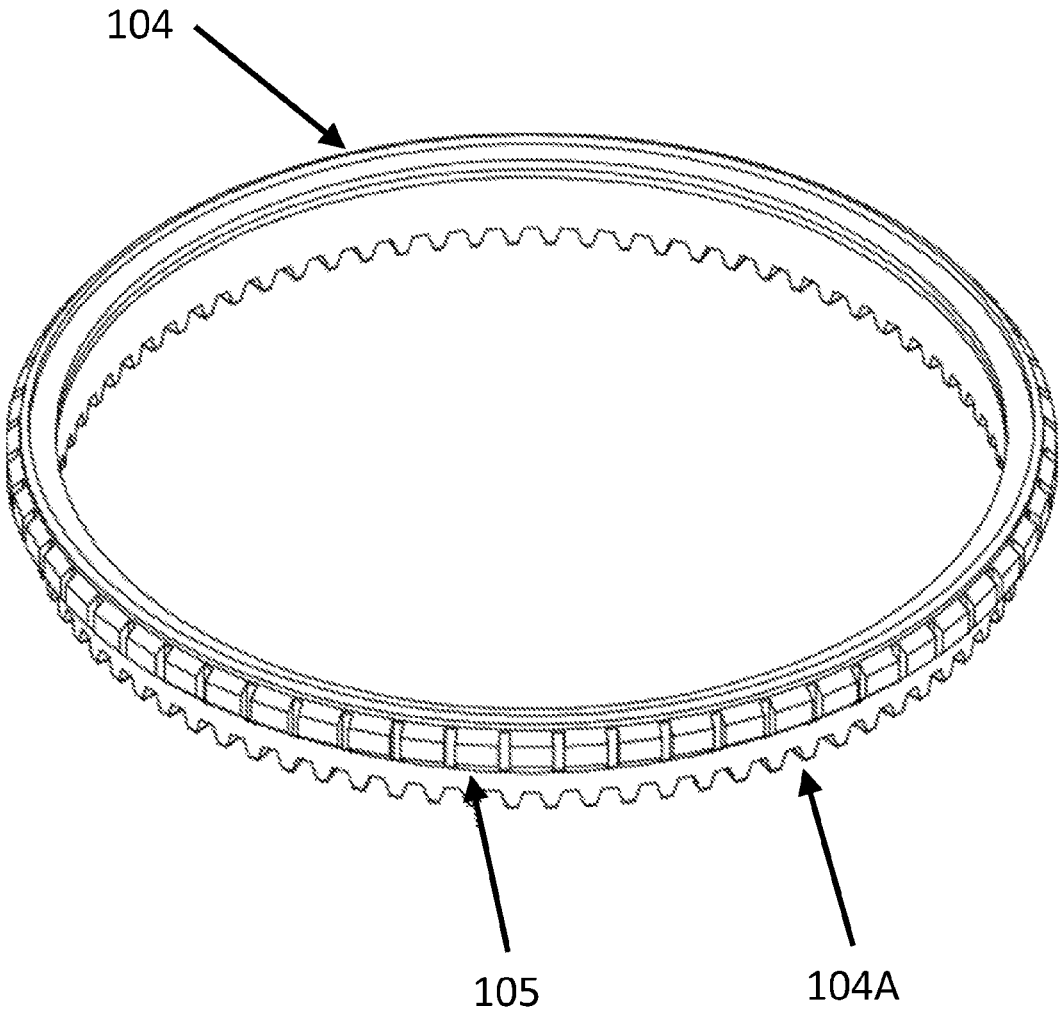
FIG. 1B is a schematic diagram showing one embodiment of a rotatable bezel.
Figure 1C:
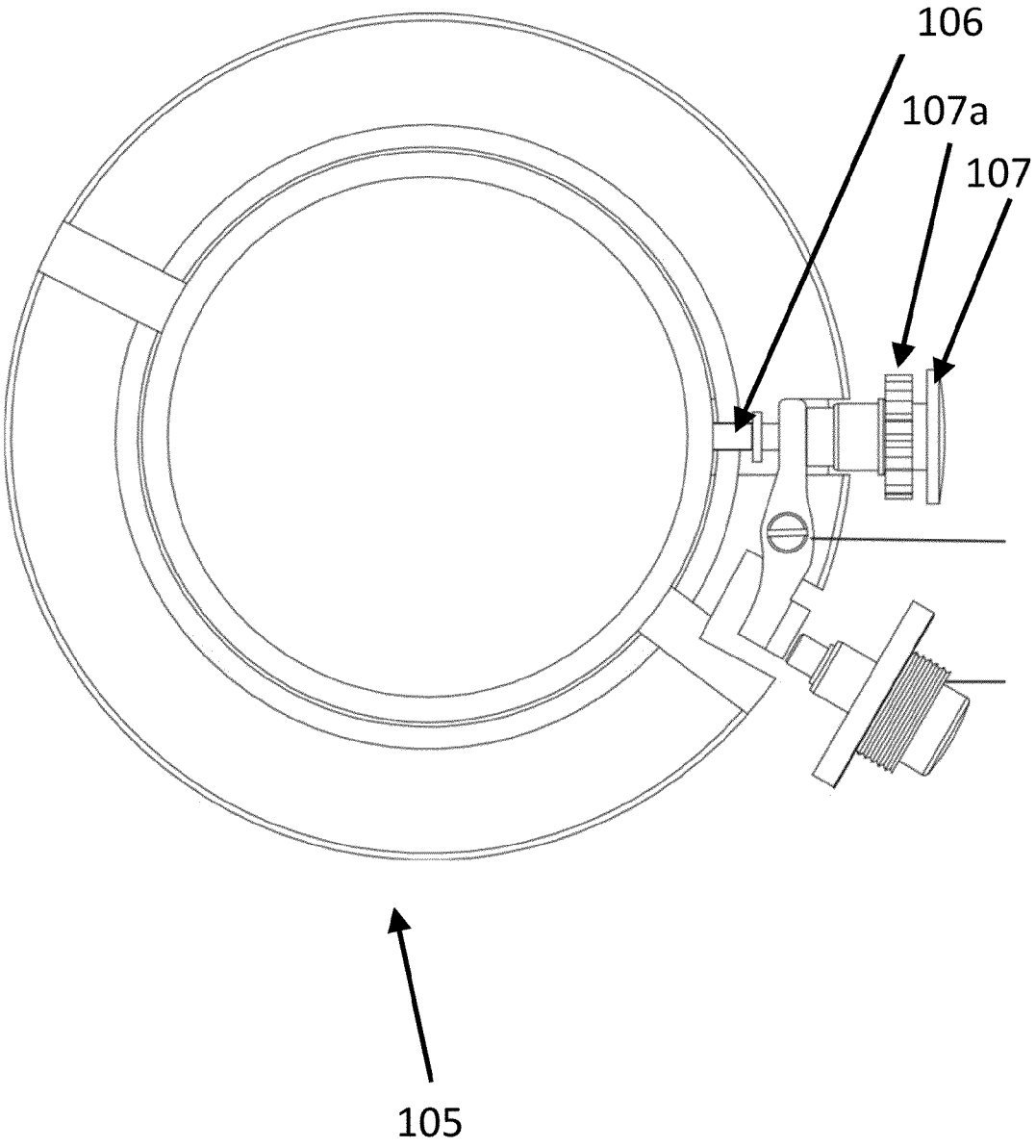
FIG. 1C is a schematic cutaway diagram showing one embodiment of the watch.

FIGS. 1A-1C depict one embodiment of a watch with a time-setting bezel 100. The watch 100 includes a watch face 101. The watch face 101 includes a time-telling mechanism including at least one hand 102. The watch face 101 is enclosed in casing 103. The watch 100 includes a rotatable bezel 104 mounted on the casing 103. The rotatable bezel 104 has a cylindrical gear element 105 fixed to the rotatable bezel 104 and projecting into the casing. The watch 100 includes a shaft 106. The shaft 106 has an axis of rotation substantially orthogonal to the axis of rotation of the rotatable bezel 104. The shaft 106 is mechanically coupled to the cylindrical gear so that the rotation of the bezel drives the rotation of the shaft.

Viewing FIG. 1A-1C in further detail, the watch 100 includes a watch face 101. The watch face 101 may have any appearance suitable for the face of a watch. The watch face 101 may be fully or partially open to show some of the works within the watch 100. The watch face 101 may include indicia to indicate units of time. The indicia may include markers for hours, minutes, or sets of minutes; for instance, the indicia may include a first kind of marker to indicate individual minutes, and a second kind of marker to indicate hours and five-minute groups. The indicia may include numerals or letters; for instance, the indicia may include numerals indicating each hour. The watch face may be luminous; the watch face may include one or more phosphorescent elements. The watch face may include a radiation emitter and phosphor that together produce light, as in a radium dial. The watch face may include one or more electric light sources. One or more of the indicia on the watch face may be luminous.

The watch face 101 includes a time-telling mechanism including at least one hand 102. The at least one hand 102 may include an hour hand. The at least one hand 102 may include a minute hand. The at least one hand 102 may include a second hand. The at least one hand 102 may include an alarm hand. The time-telling mechanism may also include additional features such as a date display; the date display may indicate the day, month, year, or any combination or equivalent thereof. The additional features may include secondary dials such as dials indicating the day of the week, stopwatch dials, and chronometer dials; the watch may include digital displays for any of those dials.

The watch face 101 is enclosed in casing 103. The casing 103 may be constructed of any material or materials suitable for the formation of a watch casing. The materials making up the casing 103 may include metal, such as stainless steel. The materials making up the casing may include natural or synthetic polymers such as plastics or silicones. In some embodiments, the casing has a shoulder for bearing the rotatable bezel 104; the shoulder may be substantially annular. The casing 103 may include a slit (not shown) through which the cylindrical gear 105 of the bezel 104 projects into the casing 103. The slit may be substantially annular in form. In some embodiments, a watch crystal is attached to the casing 103 and covers the face 101. The watch crystal may have at least one transparent region; in some embodiments, the entire crystal is transparent. The transparent regions of the crystal may be constructed of any transparent material including without limitation glass, crystal, and plexiglass. The casing may have a front, covered wholly or in part by the crystal, and displaying the face 101. The casing may have a back on the opposite side of the watch 100 works from the face. The casing 103 may have a sidewall joining the front of the casing 103 to the back of the casing. The casing 103 may have extensions for attaching a wristband or bracelet that secures the watch 100 to the wrist of a user. The casing 103 may have other transparent regions besides the crystal; for instance, the back of the casing 103 may have a transparent window to allow some of the works to be visible. The back of the casing 103 may be removable; for instance, the back of the casing 103 may have reciprocal threading with the sidewall of the casing 103, allowing the back to be screwed into position in the casing or unscrewed to expose the works of the watch 100. The casing 103 may be opened by alternate means, such as fasteners that may be unscrewed to release the back or front of the casing 103, pressure fits that can be opened by prying at a particular point on the casing, or other threaded sections. The casing may be constructed to be waterproof or water resistant; for instance, the connections between any two portions of the casing 103 may be sealed by washers or by tightly fitting sections to prevent the entry of water. Likewise, the slit through which the cylindrical gear 105 enters the casing 103 may be sealed from entry of water. The casing 103 as a whole may be waterproofed.

The watch 100 includes a rotatable bezel 104 mounted on the casing 103. The rotatable bezel 104 may be constructed from any material or combination of materials suitable for the construction of the casing 103. In some embodiments, the rotatable bezel 104 is substantially annular; the rotatable bezel 104 may be shaped to fit the substantially annular shoulder of the casing. The rotatable bezel 104 may have exterior knurls or treads or other exterior surface features that enhance the apparent friction of the rotatable bezel 104 with the hand or glove of a user. The rotatable bezel 104 may be rotated about an axis that is substantially perpendicular to the watch face; for instance, where the watch face is in the form of a dial, the rotatable bezel 104 may rotate by sliding around the circumference of the dial. The rotatable bezel 104 has a cylindrical gear element 105 fixed to the rotatable bezel 104 and projecting into the casing. In some embodiments, the cylindrical gear 105 projects into the watch casing through the slit in the watch casing. The cylindrical gear 105 may be formed from any materials or combination of materials suitable for the construction of the casing 103. The cylindrical gear 105 may have the general form of a squat, hollow cylinder or an annular band. The cylindrical gear 105 may have axially projecting gear teeth 104A; the axially projecting gear teeth 104A may project toward the back of the casing.

Figure 2:
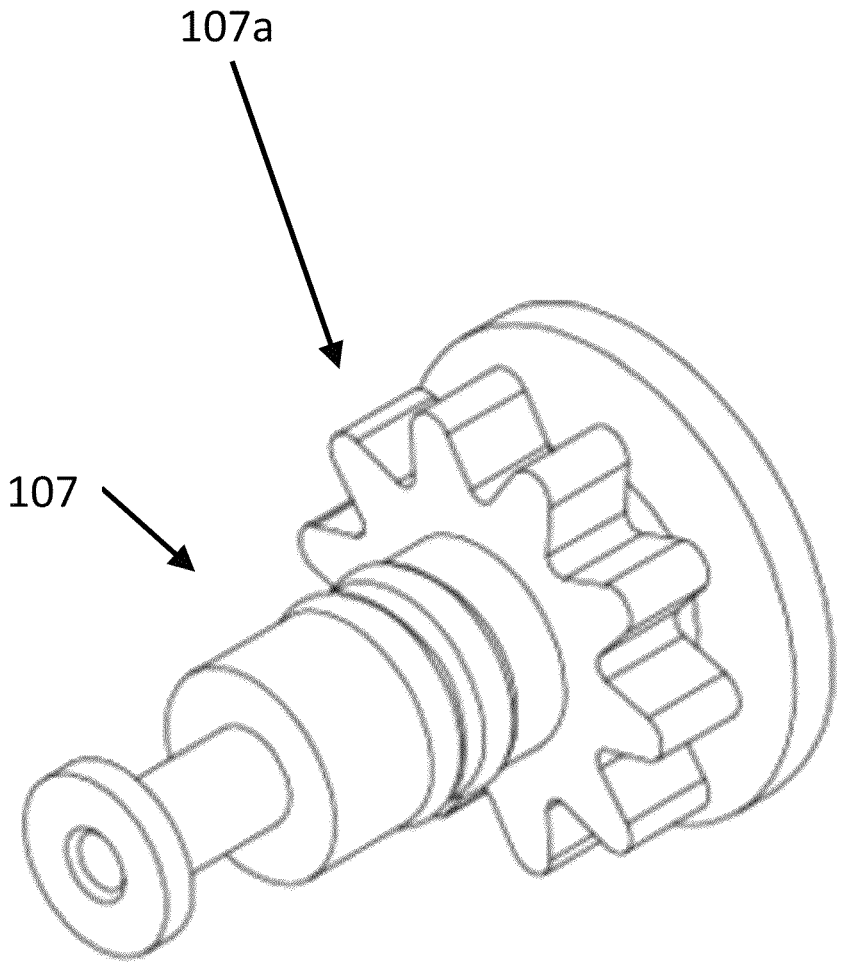
FIG. 2 is a schematic diagram showing one embodiment of a special cannon pinion.

The watch 100 includes a shaft 106. The shaft 106 may be constructed from any material or combination of materials suitable for constructing the casing 103 as described above in reference to FIGS. 1A-C. The shaft 106 has an axis of rotation substantially orthogonal to the axis of rotation of the rotatable bezel 104; for instance, the axis of rotation of the shaft may be substantially parallel to the plane of the watch face 101, like the shaft bearing the castle wheel or clutch in a conventional keyless work. The shaft 106 is mechanically coupled to the cylindrical gear 105 of the bezel 104. As a result, rotating the bezel 104 about its axis may cause the shaft 106 to rotate about its axis. In some embodiments, the shaft 106 is mechanically coupled to the cylindrical gear by a special cannon pinion 107 having a pinion gear 107*a* that engages the cylindrical gear element; for instance, where the cylindrical gear 105 includes axially projecting gear teeth, the special cannon pinion 107 may have a pinion gear 107*a* with radially projecting gear teeth that mesh with the axially projecting gear teeth. A more detailed view of an embodiment of the special cannon pinion is shown in FIG. 2. The portion of the shaft 106 bearing the cannon pinion may be squared similarly to the portion of a keyless work shaft that bears a clutch in other watches, so that the shaft 106 is slidably engaged to the special cannon pinion 107, but the shaft 106 may still be driven to rotate by the rotation of the special cannon pinion 107. Persons skilled in the art will be aware of other similar mechanisms for allowing a shaft slidably engaged to a gear to be rotated by that gear, such as splines or other polygonal cross-sectional shapes. The special cannon pinion 107 may free to rotate, relative to the casing 103, but unable to slide axially, so that the special cannon pinion 107 remains engaged to the cylindrical gear element 105.

In some embodiments, the shaft 106 engages a first gear element (not shown) within the watch so that the rotation of the shaft drives rotation of the first gear element. The shaft 106 may engage with the first gear element in the same manner as the shaft of a keyless work shaft; for instance, the shaft may have a clutch or castle wheel with axially oriented teeth that engages a gear with axially oriented teeth on another shaft mechanically coupled to the first gear element. In some embodiments, the first gear element is engaged with the time-telling mechanism so that rotation of the first gear element drives rotation of the at least one hand to set a time; for instance, the first gear element may be a hour wheel, minute wheel, cannon pinion, or another gear engaged with or included in the motion works. In other embodiments, the first gear element is engaged with a date display mechanism so that the rotation of the first gear element drives rotation of the date display mechanism to set a date. For instance, the first gear element may be a gear driving or bearing a date wheel; where a different gear train drives the display of one or more parts of a date, the first gear element may engage that gear train.

In some embodiments, the first gear element is engaged with a spring-winding mechanism so that the rotation of the first gear element drives rotation of the spring-winding mechanism to wind a spring; for instance, the first gear element may be mechanically coupled to a crown wheel or similar mechanism. Where there is more than one spring that may be wound, such as a mainspring and an alarm spring, the first gear element may wind the first spring when rotated in one direction and the second spring when rotated in the other direction. In some embodiments, the watch 100 is a wind-up watch; the first gear element may be the only or principal way to wind the mainspring of the watch 100. In other embodiments, the watch 100 is mechanical, but has different principal winding mechanism, such as the weighted rotor of an automatic watch; the first gear element may provide a second or auxiliary way to wind the mainspring. In some embodiments, the first gear element winds the watch only when rotated in one direction; thus, for instance, rotating the bezel 104 in a clockwise direction may wind the watch, whereas counter-clockwise rotation may have no effect on the tension of the mainspring. In other embodiments, the watch 100 has no mainspring; for instance, the watch may be a quartz electric watch.

In other embodiments, the shaft 106 is axially movable to another position in which the shaft 106 is disengaged from the first gear element, and the shaft 106 is engaged with a second gear element (not shown) within the watch. The second gear element may be engaged with any mechanism with which the first gear element may be engaged, as described above, including the time-telling mechanism, the date display mechanism, or the spring-winding mechanism. In some embodiments, the first gear element engages with a first mechanism while the second gear element engages with a second gear element; for instance, the first gear element may be mechanically coupled to the time-telling mechanism, while the second gear element is mechanically coupled to the date display mechanism, so that moving the shaft to the second position causes the rotation of the bezel to set the time, and moving the shaft to the third position causes the rotation of the bezel to set the date. Likewise, the first gear element may be coupled to the time-telling mechanism, while the second gear element may be coupled to a spring-winding mechanism. Alternatively, the first gear element may be coupled to the spring-winding mechanism, while the second gear element may be coupled to the date display mechanism. As an additional alternative, the first gear element may be coupled to the spring-winding mechanism while the second gear element may be coupled to the time-telling mechanism. In some embodiments, the shaft is movable to one or more additional positions in which the shaft is mechanically coupled to one or more additional gear mechanisms, which may be any gear mechanisms described above in reference to FIGS. 1A-C. Thus, for instance, the shaft may have three positions, such that the rotating bezel 104 sets the time, sets the date, or winds the mainspring depending on which position the shaft is in; each of the first, second, and third positions may engage any one of the time-telling, spring-winding, and date display mechanisms. Persons skilled in the art will be aware of many ways in which changes to the axial position of a shaft like a keyless works shaft may change the function accomplished by rotating the shaft. Movement of the shaft 106 may also engage other functions, such as a seconds hack.

In some embodiments, the watch 100 includes an object that the user can access from outside the casing 103 to move the axial position of the shaft between at least the first gear element and second gear element; the object may enable the user to move the shaft 106 between all axial positions the shaft can occupy, as described above. In some embodiments, the object allows the user to pull and push the shaft in a manner analogous to a conventional watch crown; for instance, there may be a knob that the user can pull or push to change the axial position of the shaft 106. In other embodiments, the watch 100 includes a push button 108 projecting from the casing 103, the push button 108 mechanically coupled to the shaft 106, so that pushing the push button 108 axially moves the shaft 106 between the engagement with the first gear element and the second gear element; pushing the push button 108 may move the shaft 106 between additional positions described above as well.

Figure 3:
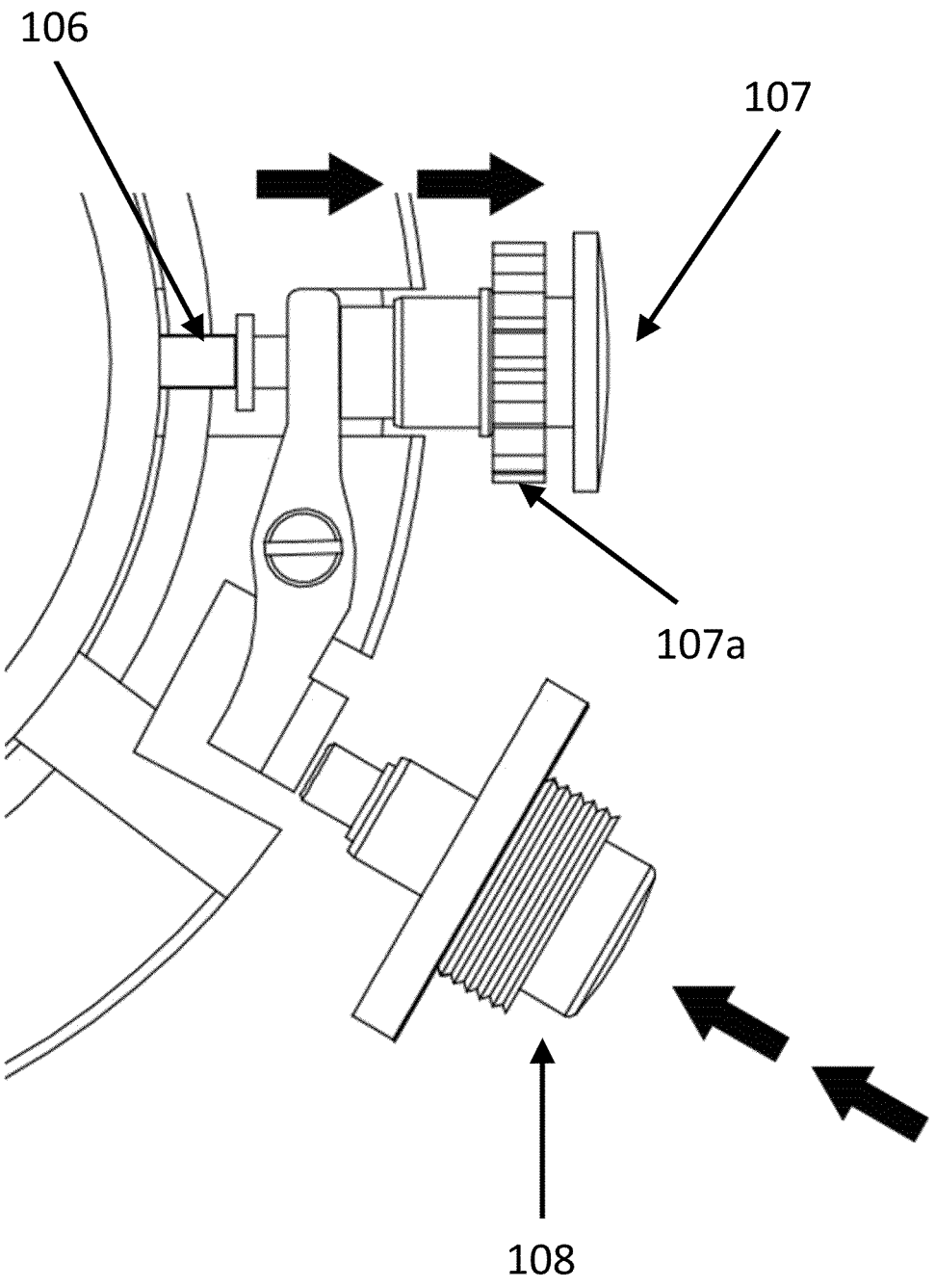
FIG. 3 is a schematic diagram showing a close-up view of one embodiment of a push-button, lever, shaft, and special cannon pinion.

In some embodiments, the mechanical coupling between the push button 108 and the shaft 106 is accomplished using a lever 109 within the casing. As shown in FIG. 3, the lever 109 may include a proximal end 110 mechanically coupled to the push button 108 so that when the push button 108 is pushed into the casing 103, the proximal end 110 moves further into the casing 103. The lever 109 may include a fulcrum 111 about which the lever 109 pivots. The lever 109 may include a distal end 112 mechanically coupled to the shaft 106, so that when the shaft 106 is in the second position and the proximal end 110 moves further into the case, the distal end 112 moves the shaft 106 outward from the first position to the second position. Where the shaft 106 is movable only between a first position and a second position, depressing the button once may cause the lever to move the shaft 106 outward from the second position to the first position; in some embodiments, the user can move the shaft back to the second position by pushing on the end of the shaft, which projects from the casing 103 or an additional button coupled to the end of the shaft. In other embodiments, the push button 108 or the proximal end 110 of the lever 109 has a return spring (not shown) which urges the button 108 and distal end 110 outward, so that the distal end 112 moves the shaft 106 and pinion 107 into the second position; any of the push button 108, special cannon pinion 107, shaft 106, or lever 109 may have a catch (not shown) that resists the bias of the return spring until the user depresses the button 108 a second time. The return spring may alternatively push the distal end 112 of the lever or the special cannon pinion 107 into the casing 103.

In other embodiments, where the shaft 106 is movable between three positions, such as a first position to wind the watch, a second position to set the date, and a third position to set the time, the push-button 108 mechanism may be configured so that pushing the button 108 a first time moves the shaft 106 axially into the second position, for instance to set the date, pushing the button 108 a second time moves the shaft 106 axially into the third position, for instance to set the time, and pushing the button 108 a third time moves the shaft 106 axially into the first position, to wind the watch. As a similar example, the shaft may be initially in the first, watch-winding position. Pressing the button a first time may cause the lever to shift the shaft into a second, date setting position, while pressing the button a second time may cause the lever to shift the shaft further out into a third position to set the time; as above, the user may be able to return the shaft to the first position by pressing a second button coupled to the end of the shaft, or by pressing the button a third time to activate a return spring, previously restrained by a catch, as described above, to return the shaft and lever to the first position. Furthermore, as persons skilled in the art will be aware, there may be one or more catches to retain the shaft 106 in the first, second, or third positions so that the shaft 106 is unlikely to shift out of its current position absent intentional movement by the user.

In some embodiments, as shown in FIG. 1A, the watch 100 includes a cap 113 that removably covers the push button 108. The cap 113 may form a waterproof seal over the push button when the cap covers the button 108. For instance, the cap 113 may form a canteen crown cover that screws down over the button 108 to form a watertight seal. In some embodiments, the cap 113 is born on an arm with a proximal end pivotally attached to the casing 103 and a distal end attached to the cap 113, so that the arm can pivot away from the casing 103 to move the cap 113 out of the way while detached, giving the user access to the button 108.

Figure 4:
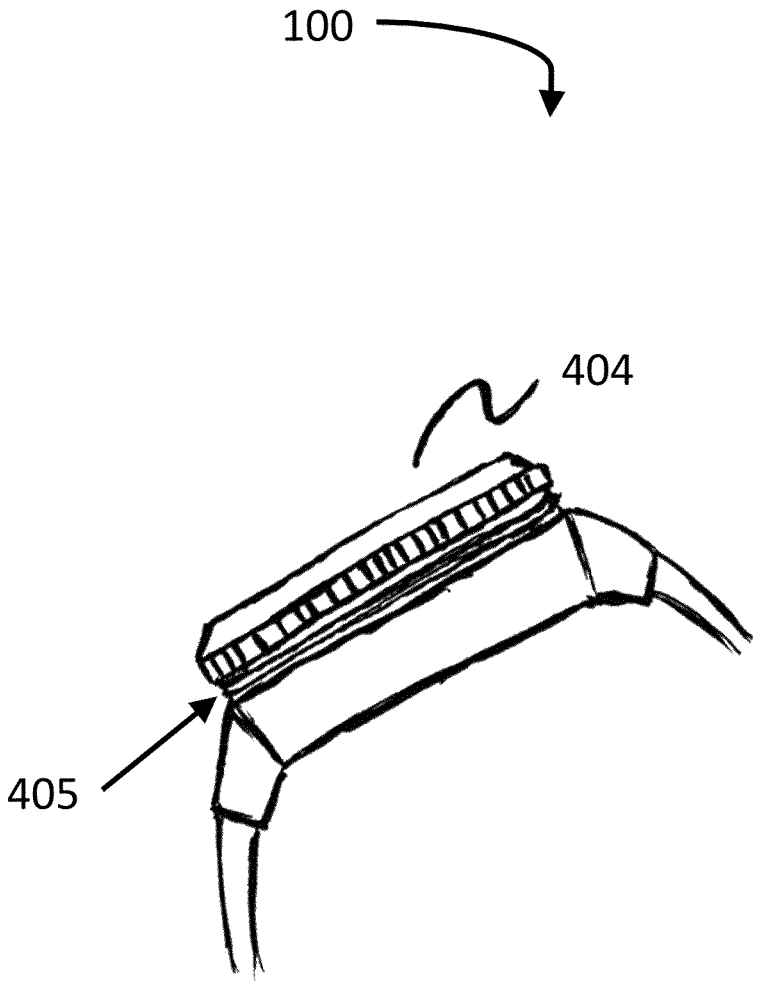
FIG. 4 is a schematic diagram showing one embodiment of the watch with an axially movable bezel.

In other embodiments, the bezel 104 is movable relative to the shaft 106 and casing 103 to disengage the shaft 106 from the cylindrical gear 105. For instance, as shown in FIG. 4, the rotatable bezel 104 may be attached to the watch 100 with some freedom to slide in the axial direction, or the direction perpendicular to the watch face. The watch 100 may include a biasing means such as a spring 405 that urges the bezel 104 away from the watchcase. When the user pushes the bezel 104 down in opposition to the spring 405, the cylindrical gear 105 may mechanically couple with the shaft 106, so that the rotation of the bezel 104 causes the rotation of the shaft. The mechanical coupling may be accomplished by a pinion born on the shaft, similarly to the special cannon pinion 107 described above in reference to FIGS. 1A-C. In some embodiments, the user can change the axial position of the shaft 106 as before by pushing a push-button (not shown), which may be implemented as described above in reference to FIGS. 1A-C. The push-button may have a cap (not shown) as described above in reference to FIGS. 1A-C.

Figure 5A:
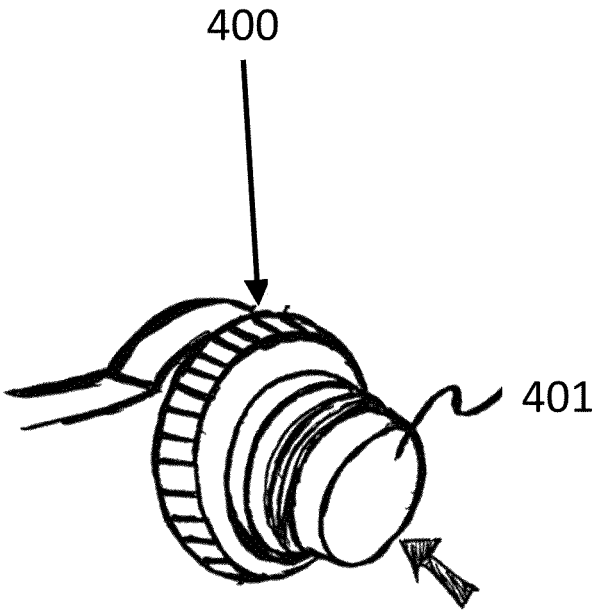
FIG. 5A is a schematic diagram showing one embodiment of an alternate mechanism to control the watch.
Figure 5B:
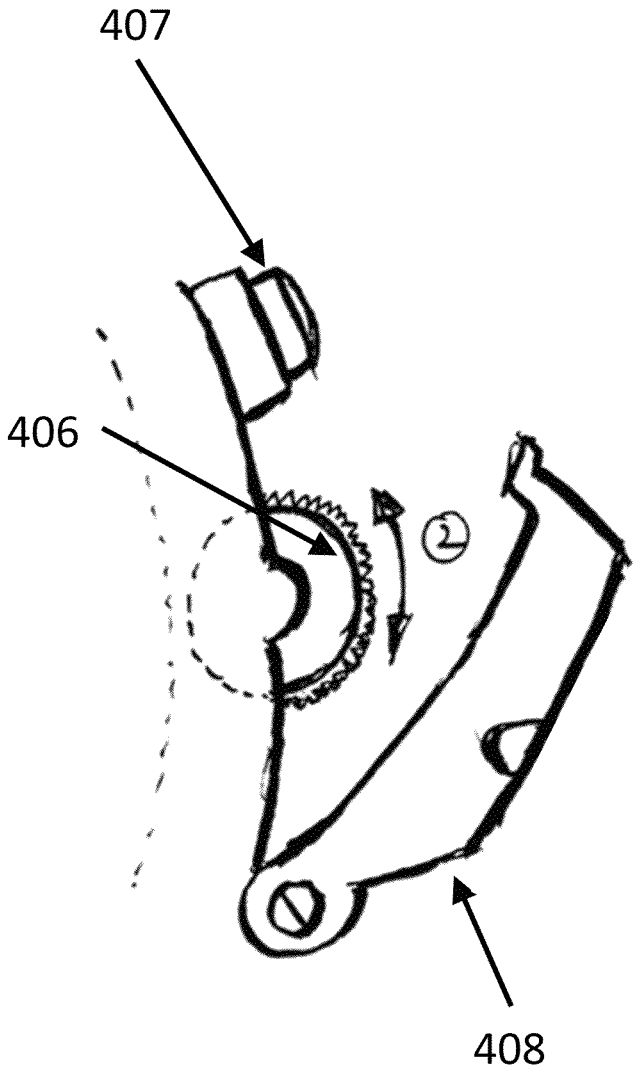
FIG. 5B is a schematic diagram showing one embodiment of an alternate mechanism to control the watch.

FIGS. 5A-5B illustrate some alternate embodiments of devices for manipulation of keyless works. In some embodiments, as illustrated in FIG. 5A, the watch does not have a rotatable bezel, and instead includes a knob 500 having the same axis of rotation as the shaft 106. The knob 500 may be mechanically coupled to the shaft 106; in one embodiment, the shaft has a squared portion that fits in a squared central hole in the knob. In other embodiments, the shaft has a gear that engages a gear driven by the knob. The shaft 106 may be movable axially between two or more positions as disclosed above in reference to FIGS. 1A-C. In some embodiments, the user can change the axial position of the shaft 106 using a push-button 502. The push-button 502 may function similarly to the push-button 108 described above in reference to FIGS. 1A-C. The watch may include a cap (not shown) that covers the push-button 502. The cap may be any cap as described above in reference to FIGS. 1A-C.

As illustrated in FIG. 5B, in some embodiments, instead of a rotatable bezel the watch includes a gear 506 that projects from the case. The gear 506 may be mechanically coupled to the shaft 106 or may be mechanically coupled to one or more time-setting mechanisms, date-setting mechanisms, or spring-winding mechanisms by a gear wheel or other gear. The gear 506 may be selectively engaged to the time-setting mechanisms by pressing a push-button 507, which may function similarly to the push-button 108 described above in reference to FIGS. 1A-1C. In other embodiments, the push-button 507 releases a crown protector 508 which covers the gear 506 to prevent its rotation.

Figure 6A:
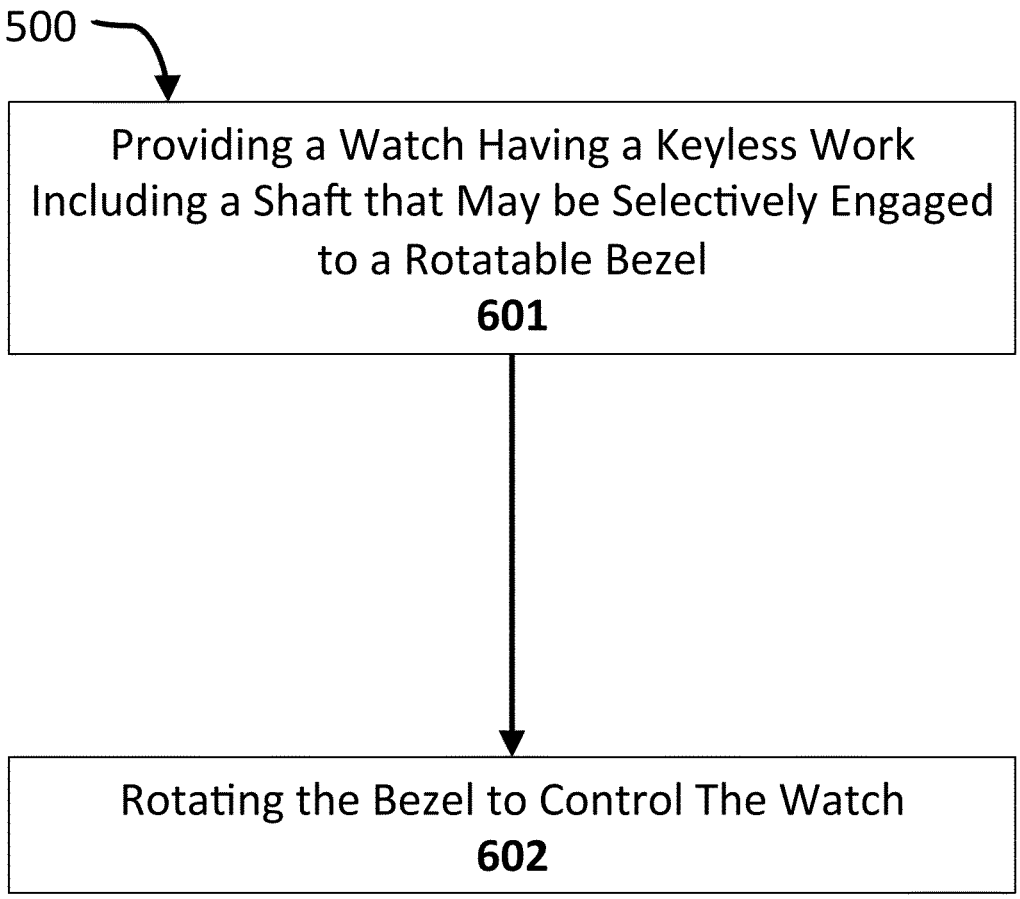
FIG. 6A is a flow diagram illustrating an embodiment of a method for controlling a watch using a rotatable bezel.

FIG. 6A is a flow chart depicting a method 600 for controlling a watch using a rotatable bezel. The method 600 includes providing a watch having a keyless work including a shaft that may be selectively engaged to a rotatable bezel (601). The method 600 includes rotating the bezel to control the watch (602).

Referring to FIG. 6A in greater detail, and by reference to FIGS. 1A-4C, the method 600 includes providing a watch having a keyless work including a shaft that may be selectively engaged to a rotatable bezel (601). The watch may be any watch 100 having a rotatable bezel as provided above in reference to FIGS. 1A-4C. In some embodiments, the watch 100 includes a shaft 106 that is axially movable between a first position in which the shaft is mechanically coupled to a cylindrical gear 105 coupled to the bezel 104 so that the rotation of the bezel drives the rotation of the shaft 106, and a second position in which the shaft 106 is not coupled to the cylindrical gear 105.

Figure 6B:
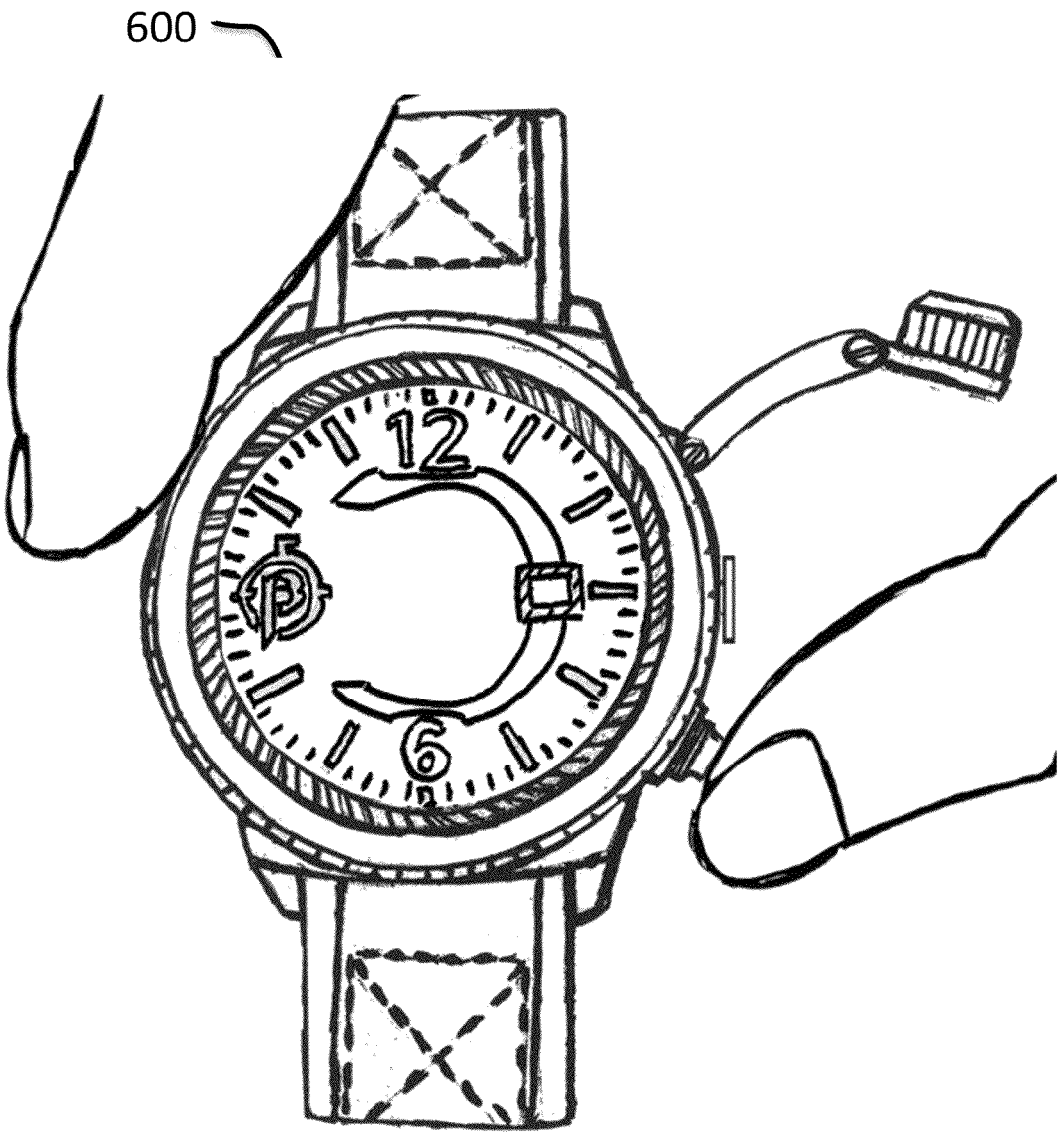
FIG. 6B is a schematic diagram illustrating an embodiment of a method for controlling a watch using a rotatable bezel.
Figure 6C:
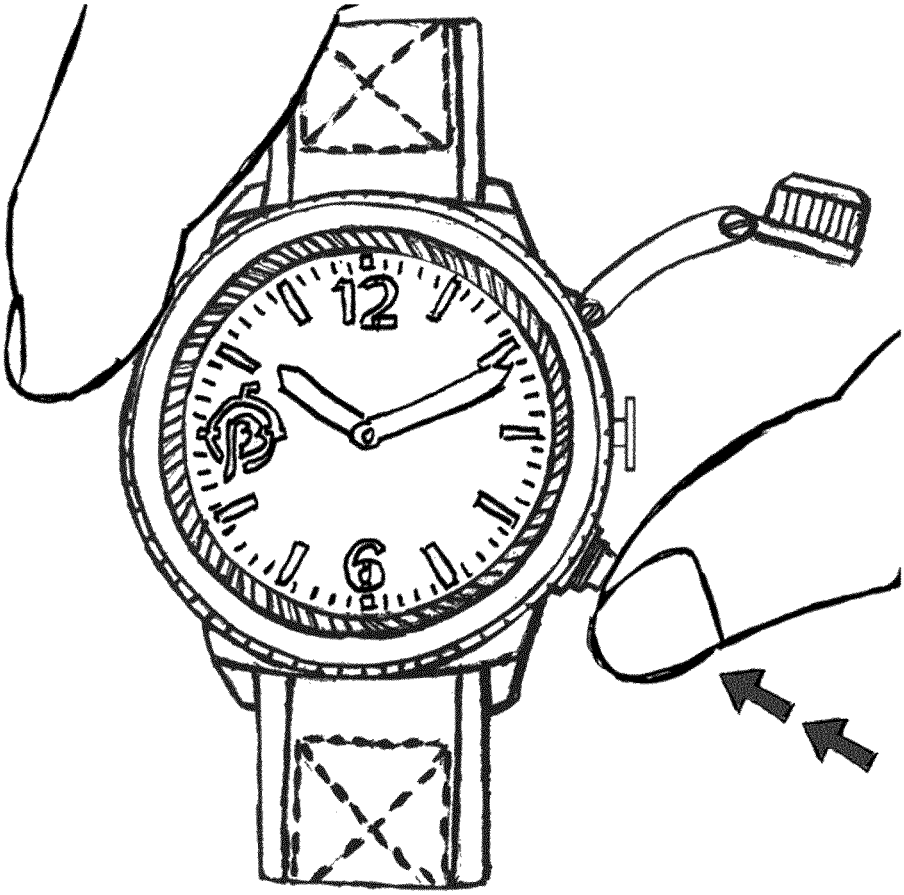
FIG. 6C is a schematic diagram illustrating an embodiment of a method for controlling a watch using a rotatable bezel.
Figure 6D:
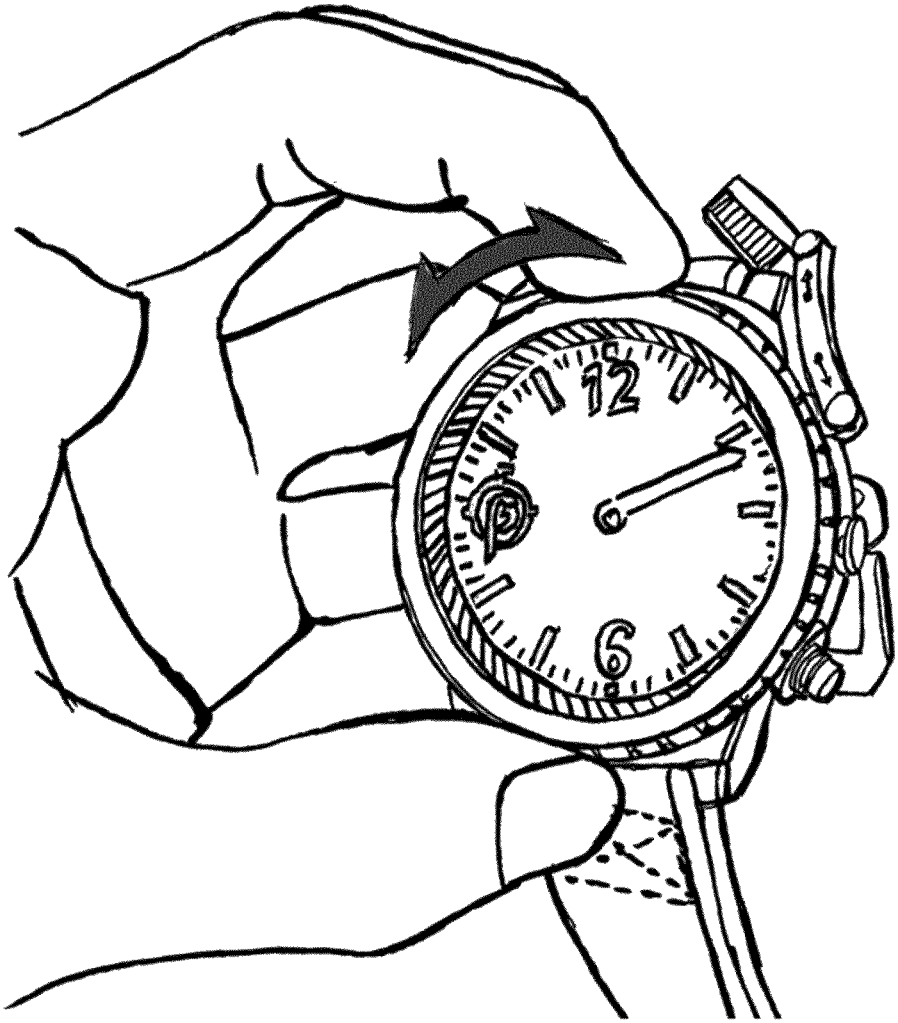
FIG. 6D is a schematic diagram illustrating an embodiment of a method for controlling a watch using a rotatable bezel.

The method 600 includes rotating the bezel to control the watch (602). This may be implemented as described above in reference to FIGS. 1A-4C; this is also further illustrated by FIG. 6B. In some embodiments, the method 600 also includes moving the shaft 106 axially to a second position or a third position, or both, as described above in reference to FIGS. 1A-4C; the method 600 may further include rotating the bezel to control the watch, as described above in reference to FIGS. 1A-4C. The movement to the third position and rotation of the bezel 104 to control the watch is further illustrated in FIGS. 6C-D. Rotating the bezel 104 to control the watch may thus include winding the watch, setting the time, or setting the date, depending on the gear element engaged in the first, second or third position, and the current axial position of the shaft 106.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A watch with a time-setting bezel, the watch comprising:

a watch face containing a time-telling mechanism including at least one hand, the watch face enclosed in a casing;

a rotatable bezel mounted on an annular shoulder of the casing, the rotatable bezel having an axis of rotation substantially perpendicular to the watch face, the rotatable bezel having a cylindrical gear element fixed to the rotatable bezel and projecting into the casing; and a shaft having an axis of rotation substantially orthogonal to the axis of rotation of the rotatable bezel, the shaft mechanically coupled to the cylindrical gear so that the rotation of the bezel drives the rotation of the shaft, the shaft engaging a first gear element within the watch so that rotation of the shaft drives rotation of the first gear element.

2. The watch of claim 1, wherein the shaft is mechanically coupled to the cylindrical gear by a special cannon pinion having a pinion gear that engages the cylindrical gear element.

3. The watch of claim 1, wherein the first gear element is engaged with the time-telling mechanism so that rotation of the first gear element drives rotation of the at least one hand to set a time.

4. The watch of claim 1, wherein the first gear element is engaged with a date display mechanism so that the rotation of the first gear element drives rotation of the date display mechanism to set a date.

5. The watch of claim 1, wherein the first gear element is engaged with a spring winding mechanism so that the rotation of the first gear element drives rotation of the spring winding mechanism to wind a spring.

6. The watch of claim 1, wherein the shaft is axially movable to disengage from the first gear element and engage with a second gear element within the watch.

7. The watch of claim 6, wherein the second gear element is engaged with the time-telling mechanism so that rotation of the second gear element drives rotation of the at least one hand to set a time.

8. The watch of claim 6, wherein the second gear element is engaged with a date display mechanism so that the rotation of the second gear element drives rotation of the date display mechanism to set a date.

9. The watch of claim 6, wherein the second gear element is engaged with a spring winding mechanism so that the rotation of the second gear element drives rotation of the spring winding mechanism to wind a spring.

10. The watch of claim 6 further comprising a push button projecting from the casing, the push button mechanically coupled to the shaft, so that pushing the push button moves the shaft axially between the first position and the second position.

11. The watch of claim 10 further comprising a lever in the casing, the lever comprising:

a proximal end mechanically coupled to the push button so that when the push button is pushed into the case, the proximal end moves further into the case;

a fulcrum about which the lever pivots; and a distal end mechanically coupled to the shaft, so that when the shaft is in the second position and the proximal end moves further into the case, the distal end moves the shaft outward from the first position to the second position.

12. The watch of claim 10 further comprising a removable cap that covers the push button.

13. The watch of claim 6, wherein the shaft is axially movable to disengage from the second gear element and engage with a third gear element within the watch.

14. The watch of claim 13, wherein the third gear element is engaged with the time-telling mechanism so that rotation of the third gear element drives rotation of the at least one hand to set a time.

15. The watch of claim 13, wherein the third gear element is engaged with a date display mechanism so that the rotation of the third gear element drives rotation of the date display mechanism to set a date.

16. The watch of claim 13, wherein the third gear element is engaged with a spring winding mechanism so that the rotation of the third gear element drives rotation of the spring winding mechanism to wind a spring.

17. The watch of claim 13 further comprising a push button projecting from the casing, the push button mechanically coupled to the shaft, so that pushing the push button moves the shaft axially between the first position, the second position and the third position.

18. The watch of claim 17 further comprising a lever in the casing, the lever comprising:

a proximal end mechanically coupled to the push button so that when the push button is pushed into the case, the proximal end moves further into the case;

a fulcrum about which the lever pivots; and a distal end mechanically coupled to the shaft, so that when the shaft is in the second position and the proximal end moves further into the case, the distal end moves the shaft outward from the second position to the third position.

19. The watch of claim 17 further comprising a removable cap that covers the push button.

20. A method for controlling a watch using a rotatable bezel, the method comprising:

providing a watch having a keyless work including a shaft that may be selectively engaged to a rotatable bezel, the shaft engaging a first gear element within the watch so that rotation of the shaft drives rotation of the first gear element; and rotating the bezel to control the watch.

* * * * *